United States Patent [19]

Fournier et al.

[11] Patent Number: 4,706,614

[45] Date of Patent: Nov. 17, 1987

[54] DEVICE FOR SUSPENDING A BUNDLE OF HORIZONTAL TUBES IN A VERTICAL PLANE AND METHOD OF FABRICATING THE DEVICE

[75] Inventors: Jean Fournier; Henri Patron, both of Rochefort en Yvelines, France

[73] Assignee: Stein Industrie, Velizy-Villacoublay, France

[21] Appl. No.: 847,139

[22] Filed: Apr. 2, 1986

Related U.S. Application Data

[63] Continuation of Ser. No. 673,241, Nov. 19, 1984, abandoned.

[30] Foreign Application Priority Data

Nov. 25, 1983 [FR] France ..... 83 18814

[51] Int. Cl.[4] ..... F22B 37/24

[52] U.S. Cl. ..... 122/510; 122/235 A; 122/6 A

[58] Field of Search ..... 165/102; 122/510, 511, 122/512, 6 A, 235 A

[56] References Cited

U.S. PATENT DOCUMENTS

| | | | |
|---|---|---|---|
| 1,815,750 | 7/1931 | Watts | 122/510 |
| 2,175,555 | 10/1939 | Brown | 122/510 |
| 2,842,104 | 7/1958 | Culver | 122/510 |
| 2,884,911 | 5/1959 | Jankowski | 122/510 |
| 3,267,913 | 8/1966 | Bruhl | 122/510 |
| 3,838,665 | 10/1974 | Astrom | 122/235 A |
| 4,307,777 | 12/1981 | Chwyla | 122/510 |
| 4,347,810 | 9/1982 | Rees | 122/510 |
| 4,356,795 | 11/1982 | Loiez | 122/510 |

FOREIGN PATENT DOCUMENTS 2336621 7/1977 France .

*Primary Examiner*—Henry C. Yuen

*Attorney, Agent, or Firm*—Sughrue, Mion, Zinn, Macpeak & Seas

[57] ABSTRACT

A device for suspending a bundle of horizontal tubes in a vertical plane (1), the device comprising pairs (4, 5, 6) of vertical tubes (7, 8) provided with half-fins on their facing sides. The half-fins have a profile including notches of circular shape, having a radius slightly larger than the radius of the tubes in the bundle and being at the same spacing as said tubes, the notches being separated by tongues (16, 18, 20, 17, 19, 21) which project from the vertical tubes by a distance which is long enough to provide good support for the tubes of the bundle and which is short enough to ensure good thermal conduction from their projecting ends to their weld zones on the corresponding vertical tubes.

2 Claims, 3 Drawing Figures

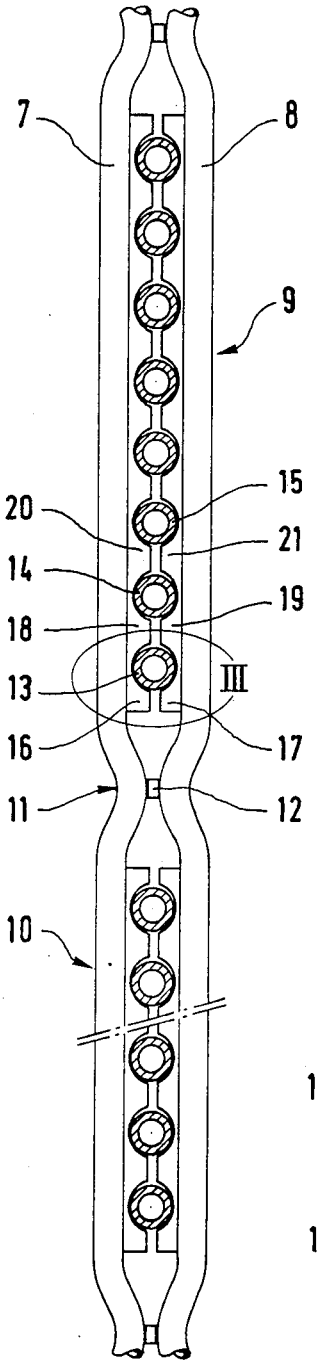
FIG. 2
FIG. 3
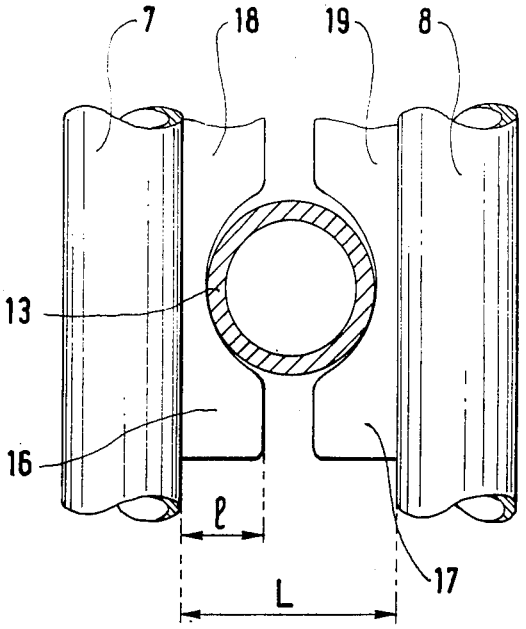

DEVICE FOR SUSPENDING A BUNDLE OF HORIZONTAL TUBES IN A VERTICAL PLANE AND METHOD OF FABRICATING THE DEVICE

This is a continuation of application Ser. No. 673,241, now abandoned, filed Nov. 19, 1984.

The present invention relates to a device for suspending a bundle of horizontal tubes in a vertical plane, in particular for the boilers of superheated steam generators, the device comprising pairs of vertical tubes provided with half-fins on their facing sides. The invention also extends to a method of fabricating the device.

BACKGROUND OF THE INVENTION

One proposed suspension device of this type comprises a fin pierced by holes of slightly larger diameter than the diameter of the tubes to be supported and at the same pitch as the tubes of the bundle. Thus, each vertical tube includes a kind of half-fin which is fixed to the half-fin of the other vertical tube by bridges disposed between successive horizontal tubes of the bundle, but the mid portions of the bridges which are in contact with the high temperature horizontal tubes and which are relatively far away from the two vertical tubes are poorly cooled by conduction. The bridges formed between the vertical tubes oxidize or rust rapidly because of their high temperature in gases which are often corrosive. Furthermore, this device is only applicable to single loop heat exchangers since it would otherwise be impossible to thread the tubes individually through the holes in the fin.

Proposals have also been made to weld saddles between the horizontal tubes of the bundle and the vertical load-bearing tubes. The saddles are close enough to the vertical tubes to be properly cooled by conduction, but the tubes of the bundle are rigidly connected thereto which gives rise to large stresses due to thermal expansion or to vibration, and these can lead to cracks in the welds.

Proposals have also been made to weld flats between two adjacent parallel vertical tubes. However, these flats are too big and suffer from the problem mentioned above concerning the fin pierced by holes. The middle portions of the flats are poorly cooled by conduction and are thus subjected to excessive temperatures which can lead to their destruction by oxidation or corrosion.

Finally, U.S. Pat. No. 3,267,913 proposes a suspension device comprising pairs of vertical tubes fitted with half-fins including circular notches for housing the horizontal tubes and separated by un-notched zones. The horizontal tubes are welded to the notches and come into contact with the vertical tubes. The connection between the horizontal tubes and the vertical tubes is thus rigid, thereby leading to high stresses due to thermal expansions and to vibration as mentioned above.

Preferred embodiments of the present invention provide a suspension device which does not include a poorly cooled zone, and which is thus less exposed to corrosion, and which is not rigidly fixed to the tubes of the heat exchanger so as to avoid weld cracking due the effects of thermal stresses or vibration.

SUMMARY OF THE INVENTION

The present invention provides a device for suspending a bundle of horizontal tubes in a vertical plane, the device comprising pairs of vertical tubes provided with half-fins on their facing sides, wherein the half-fins have a profile including notches of circular shape, having a radius slightly larger than the radius of the tubes in the bundle and being at the same spacing as said tubes, the notches being separated by tongues which project from the vertical tubes by a distance which is long enough to provide good support for the tubes of the bundle and which is short enough to ensure good thermal conduction from their projecting ends to their weld zones on the corresponding vertical tubes.

In addition, the device preferably includes at least one of the following features:

The tongues project from the vertical tubes by a distance in the range 25% to 40% of the gap between the two tubes.

Adjacent vertical tubes include spaced kinks which bring the tubes towards each other and where they are welded to horizontal spacers.

The present invention also provides a method of fabricating such a suspension device, wherein at least one junction fin is welded between a pair of vertical tubes, the fin is pierced by holes of a diameter which is slightly larger than the diameter of the tubes of the bundle to be supported, and then the zones of the fin lying between the holes and parallel to the axes of the vertical tubes are cut away to eliminate a middle portion which would have insufficient thermal conduction to the vertical tubes, the remaining separated half portions of fin nevertheless projecting far enough towards one another to provide adequate support for the tubes of the bundle.

According to a preferred variant the fin is cut away in such a manner that the width of the removed middle portion lies in the range 20% to 50% of the original width of the fin.

Advantageously a plurality of junction fins are welded one above another between the vertical tubes, leaving empty zones of reduced height between successive fins, the vertical tubes then being are kinked to come close to each other in the empty zones, and being welded to horizontal spacers in said zones.

BRIEF DESCRIPTION OF THE DRAWINGS

A device for suspending a bundle of horizontal tubes in a superheater or in a resuperheater of a steam generator is described below by way of example and with reference to the accompanying drawings, in which:

FIG. 2 is a section on a line II—II in FIG. 1, showing a portion of a pair of vertical suspension tubes; and FIG. 3 is a view on a larger scale of a detail III in FIG. 2, showing one tube of the bundle, the notches in which it is engaged and the tongues which support it.

MORE DETAILED DESCRIPTION

Figure 1:
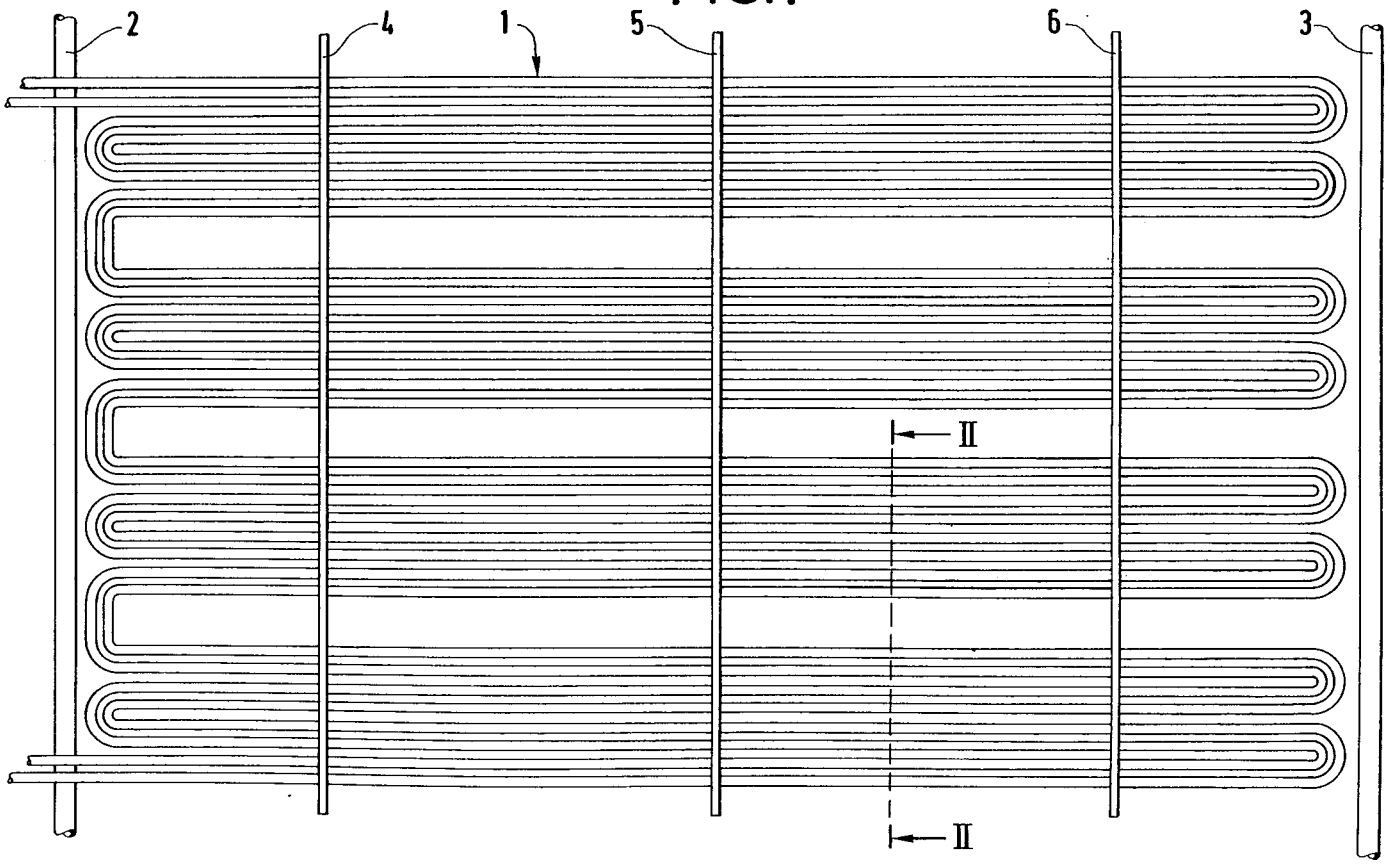
FIG. 1 is an elevation of a bundle of tubes.

In FIG. 1, the superheater bundle of horizontal tubes 1 is disposed between cooled vertical screens 2 and 3. It is suspended from pairs of vertical tubes 4, 5, 6 which are fixed to the top part of the boiler in a manner not shown.

In FIG. 2, vertical suspension tubes 7 and 8 are provided with half-fins in zones 9 and 10 which are separated by a zone 11 where the tubes are kinked towards each other and are welded to a horizontal spacer 12. The horizontal tubes 13, 14, and 15 of the bundle, are disposed in notches in the half-fins which are welded to the vertical tubes. The notches are separated by tongues 16, 18, and 20 for the tube 7 and by tongues 17, 19 and 21 for the tube 8. These notches have a radius of curvature which is slightly larger than the radius of the tubes 13, 14, 15 such that the tubes can be inserted therein with a small amount of play but still have a good contact surface with the half-fins that are welded to the vertical tubes. In addition, the tongues 16, 18, 20, 17, 19, 21 do not have their projecting ends too far from the corresponding vertical tube so that they remain well cooled by conduction from said tube.

FIG. 3 shows a detail III of FIG. 2 on a larger scale. The tongues 16, 18, 17 and 19 project from their respective vertical tubes by a distance 1 which lies in the range 25% to 40% of the width L of the gap between the vertical tubes. As may be appreciated by viewing FIGS. 2 and 3, the distance between opposed circular notches within facing half-fins of respective vertical tubes 7, 8, at the centerline of the notches are slightly in excess of the diameter of the pipes 13, 14, 15 inserted therein and which pipes rest against the lower surface of the notches, resulting from the spacing between the vertical tubes 7, 8 as achieved by horizontal spacers 12 welded to respective tubes at opposite sides where the tubes are kinked toward each other. As a result thereof, there is a small play between the horizontal tube received within the notches and the notches of the fins, as a result thereof as readily seen in FIG. 3, the axis of the horizontal tube 13 is not in the horizontal plane of symmetry of the notches, but a little below, thereby eliminating high stressing due to thermal expansions and vibrations since the connection between the horizontal tubes and the vertical support tubes 7 and 8 are loose rather than rigid.

The profile of the half-fins welded to the vertical tubes is obtained by cutting away a middle portion from a single fin spanning the gap between the tubes using means which ensure a regular profile without sharp edges.

The invention is mainly applicable to superheat and resuperheat bundles in boilers subjected to corrosive combustion gases; however, it is also applicable other bundles of horizontal tubes in contact with corrosive gases at high temperatures, eg. in the chemical industry.

What is claimed is:

1. A device for suspending a bundle of horizontal tubes in a vertical plane, said device comprising pairs of vertical tubes provided with half-fins on their facing sides, said half-fins being welded at weld zones along one edge, respectively, to said pairs of vertical tubes, the improvement, wherein said half-fins have a profile including notches of circular shape, having a radius slightly larger than the radius of the horizontal tubes of the bundle and being at the same spacing as said horizontal tubes, the notches being separated by tongues which project from the vertical tubes by a distance which is long enough to provide good support for the horizontal tubes of the bundle and which is short enough to ensure good thermal conduction from their projecting ends to their weld zones on the corresponding vertical tubes, and wherein said device further comprises means for fixably connecting said vertical tubes to each other, such that the distance between opposed circular notches and the horizontal plane of symmetry of the notches is slightly larger than the diameter of the horizontal tubes passing therethrough, whereby said horizontal tubes rest on the bottoms of said circular notches of the facing half-fins for effective heat transfer therebetween with the axes of the tubes being slightly below the horizontal plane of symmetry of the notches and the assembly of horizontal tubes being free of stresses due to thermal expansion and vibration, and wherein adjacent vertical tubes include spaced, oppositely directed lateral kinks which bring the tubes towards each other and horizontal spacers having ends welded to kinks of respective vertical tubes.

2. A device according to claim 1, wherein the projecting length of the tongues lies in the range 25% to 40% of the width of the gap between the corresponding pair of vertical tubes.

* * * * *